United States Patent [19]

Naoi et al.

[11] 4,407,939

[45] Oct. 4, 1983

[54] PHOTOGRAPHIC LIGHT-SENSITIVE MATERIAL WITH SUBBING LAYERS

[75] Inventors: Takashi Naoi; Hiroshi Kawasaki; Jun Yamaguchi; Sumitaka Tatsuta, all of Fujinomiya; Hidefumi Sera, Minami-ashigara, all of Japan

[73] Assignee: Fuji Photo Film Co., Ltd., Kanagawa, Japan

[21] Appl. No.: 250,331

[22] Filed: Apr. 2, 1981

[30] Foreign Application Priority Data

Apr. 2, 1980 [JP] Japan ..... 55-43378
Apr. 2, 1980 [JP] Japan ..... 55-43379

[51] Int. Cl.[3] ..... G03C 1/78; G03C 1/96

[52] U.S. Cl. ..... 430/536; 430/537; 430/539; 430/531; 430/538

[58] Field of Search ..... 430/536, 539, 534, 538, 430/531, 537, 642

[56] References Cited

U.S. PATENT DOCUMENTS

| | | | |
|---|---|---|---|
| 2,527,267 | 10/1950 | Hart et al. | 430/539 |
| 3,271,178 | 9/1966 | Nadeau et al. | 430/536 |
| 3,582,339 | 6/1971 | Martens et al. | 430/539 |
| 3,811,913 | 5/1974 | Kasugai et al. | 430/537 |
| 3,988,157 | 10/1976 | Van Paesschen et al. | 430/536 |
| 4,291,120 | 9/1981 | Kobayashi et al. | 430/536 |

OTHER PUBLICATIONS

Mees and James, *The Theory of the Photographic Process,* The Macmillan Co., New York, ©1966, p. 54.

*Primary Examiner*—Richard L. Schilling
*Attorney, Agent, or Firm*—Sughrue, Mion, Zinn, Macpeak and Seas

[57] ABSTRACT

A photographic light-sensitive material composed of a support having a subbing layer and a silver halide emulsion layer formed thereon. The subbing layer comprised of a first subbing layer disposed to the support and a second subbing layer containing (i) a gelatin derivative and/or (ii) a polymer having the recurring unit shown by general formula (I) and/or (II)

(I)

wherein R is a hydrogen, an alkyl group having 1 to 6 carbons, or a halogen; M is hydrogen, an alkali metal, an alkaline earth metal, or an organic base; X is an alkyl group having 1 to 6 carbons, an alkoxy group having 1 to 6 carbons, an alkylamino group having 1 to 6 carbons, or a halogen; m is 0, 1 or 2; and n is 1 or 2

(II)

wherein R′ is hydrogen or an alkyl group; X′ is a hydrogen, a halogen, a nitro group, a cyano group, an alkyl group, an alkoxy group, an alkoxycarbonyl group, an alkylsulfonyl group, an aryloxy group, an acyl group, an acyloxy group, or an acylamido group; m′ is 0, 1 or 2; and n′ is 1 or 2.

17 Claims, No Drawings

PHOTOGRAPHIC LIGHT-SENSITIVE MATERIAL WITH SUBBING LAYERS

FIELD OF THE INVENTION

The present invention relates to a photographic light-sensitive material and more particularly, to a material in which the photographic layers are comprised of hydrophilic organic colloids provided on a plastic film support having a hydrophobic surface.

BACKGROUND OF THE INVENTION

Polyethylene terephthalate, cellulose triacetate, polystyrene, polycarbonate and like polymers have been prevailingly used as photographic support materials due to their desirable characteristics such as a high degree of transparency, and flexibility. However, difficulties arise when using these polymers as support materials, for such supports have hydrophobic surfaces and photographic layers to be coated on the supports (e.g., a light-sensitive silver halide emulsion layer, an interlayer, a filter layer, etc.) are made up of protective colloids containing gelatin as a main component. Therefore, it is difficult to firmly adhere a photographic layer to the surface of the support. In an attempt to obtain stronger adhesion, various treatments have been developed for activating the surfaces of hydrophobic supports. Examples of types of surface activating treatments include chemical treatments, mechanical treatments, corona discharge treatments, flame treatments, ultraviolet ray treatments, high frequency wave treatments, glow discharge treatments, activated plasma treatments, laser treatments, mixed acid treatments, and ozone oxidation treatments. Two general techniques have been used to increase adhesiveness between a hydrophobic support and a photographic layer. According to one technique, a photographic emulsion is coated directly on the surface of a hydrophobic support treated by one or more of the above-described surface treatments. According to another technique, after a hydrophobic support has been treated by one or more of the above-described surface treatments, a subbing layer is provided on the support and then a photographic emulsion is coated on the subbing layer. This technique is described in U.S. Pat. Nos. 2,698,241, 2,764,520, 2,864,755, 3,462,335 and 3,475,193, British Pat. Nos. 788,365, 804,005 and 891,469.

Of the two techniques, the latter is more effective and prevails now. All of the surface treatments are intended to create polar groups to some degree. Some treatments also increase cross-linking density at the surface of a support which is hydrophobic by nature. This increases the affinity for polar groups of a certain component contained in a subbing solution, as well as increasing the fastness at the interface formed between the support and the subbing layer by adhesion. In addition, various different subbing layers have been developed. For instance, a double layer process in which a layer which can adhere well to a support is first provided on the support (hereinafter the first subbing layer). On top of the first layer is coated a hydrophilic resin layer which can strongly adhere to a photographic layer (hereinafter the second subbing layer). In a single layer process a resin having both hydrophobic and hydrophilic groups is coated on a support.

Both processes have been closely studied. A number of resins have been examined to determine their usefulness as the first subbing layer in the double layer process. For example, copolymers prepared using as starting materials monomers selected from a group comprising of vinyl chloride, vinylidene chloride, butadiene, methacrylic acid, acrylic acid, itaconic acid and maleic anhydride; polyethylene imine; epoxy resin; grafted gelatin; and nitrocellulose. Gelatins have been principally tested for their usefulness as a second subbing layer. These processes have been shown to possess satisfactory adhesion power to a conventional gelatin silver halide photographic emulsions. However, recently there has been a tendency to decrease the silver contents in silver halide photographic light-sensitive materials in order to conserve resources. In order to prevent the lowering in image density with a low silver content, it is necessary to swell photographic layers largely during development-processing. This requires a reduction in the contents of hardeners in the photographic layers. When the hardener content is decreased, a new problem develops involving the adhesion strength between a photographic layer and the second subbing layer. The adhesion becomes insufficient, particularly at the development-processing stage. Subbing solutions for the first subbing layer may contain an aldehyde series, an active vinyl series, an active halogen series and like series hardeners. In many cases, such a hardener is incorporated into the first subbing layer in a large amount. This creates strong adhesion between the first subbing layer and the plastic film support. However, the increased hardener content in the first subbing layer causes a reduction in adhesion strength between the second subbing layer and photographic layer. In addition, the subbing layer containing a large amount of hardener exerts undesirable influences upon photographic characteristic, such as lowering image density.

SUMMARY OF THE INVENTION

The present invention is an interlayer developed to overcome the above-described disadvantages.

An object of the present invention is to provide a photographic light-sensitive material having strong adhesiveness between the second subbing layer and photographic layer even when the hardener content in the photographic layer is reduced to control the photographic characteristic thereof.

A second object is to provide a photographic light-sensitive material having strong adhesiveness between the second subbing layer and a photographic layer even when a large amount of hardener is incorporated in the first subbing layer in order to confer strong adhesiveness to the support for the first subbing layer.

A third object is to provide a subbing solution which possesses considerably low adverse effects upon the photographic characteristic.

A fourth object is to provide a subbing solution which does not irritate human skin.

The above-described objects are attained with a photographic light-sensitive material which has on a support at least one subbing layer (the first subbing layer) and at least one light-sensitive emulsion layer, and further has a layer containing a gelatin derivative (the second subbing layer) between the first subbing layer and the light-sensitive emulsion layer.

The above-described objects can also be attained by a photographic light-sensitive material comprising a support having thereon at least one subbing layer and at least one photographic layer, said photographic material further having a layer containing a polymer having a recurring unit shown by following general formula (I) and/or (II)

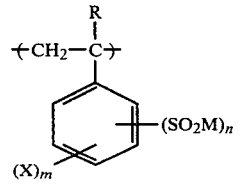

(I)

wherein R represents hydrogen, an alkyl group having 1 to 6 carbon atoms, or a halogen; M represents hydrogen, an alkali metal, an alkaline earth metal, or an organic base; X represents an alkyl group having 1 to 6 carbon atoms, an alkoxy group having 1 to 6 carbon atoms, an alkylamino group having 1 to 6 carbon atoms, or halogen atom; m represents 0, 1 or 2; and n represents 1 or 2,

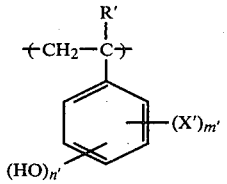

(II)

wherein R′ represents hydrogen or an alkyl group; X′ represents hydrogen, a halogen, a nitro group, a cyano group, an alkyl group, an alkoxy group, an alkoxycarbonyl group, an alkylsulfonyl group, an aryloxy group, an acyl group, an acyloxy group, or an acylamido group; m′ represents 0, 1 or 2; and n′ represents 1 or 2.

DETAILED DESCRIPTION OF THE INVENTION

In the first embodiment of the present invention, the essential component of the second subbing layer is a gelatin derivative. The term "gelatin derivatives" as used herein is intended to mean a chemically modified gelatin formed as a result of a reaction of amino groups, imino groups, carboxyl groups and/or hydroxyl groups of various amino acids making up the gelatin molecule with a mono-functional compound having a functional group as defined hereinafter.

The term "gelatin" is used to describe starting materials used for the preparation of the gelatin derivatives. Gelatin is a technical name for the protein substances derived from collagen. The gelatin includes any other synthetic products substantially equivalent to the protein substances derived from collagen. The term "gelatin" includes: (1) alkali-processed gelatin which involves processing with lime or its equivalent in a process of derivation from collagen; (2) acid-processed gelatin which involves processing with hydrochloric acid or its equivalent in the same process as described above; (3) enzyme-processed gelatin which involves processing with hydrolase or its equivalent; and (4) low molecular weight products obtained by subjecting each of these gelatins to hydrolytic cleavages by various means. Any of the above-described gelatins can be used to prepare gelatin derivatives indispensable for the practice of the present invention.

A mono-functional compound which includes a functional group capable of undergoing a reaction with an amino, an imino, a carboxyl and/or a hydroxyl group (which groups are contained in a gelatin molecule) is used in the preparation of gelatin derivatives. Typical examples of functional groups as described above include —NCO, —NCS, —NH.CO.$SO_3M^1$, —NH.CS.-$SO_3M^1$ (wherein $M^1$ represents an alkali metal such as sodium or potassium),

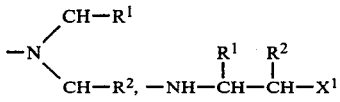

(wherein $R^1$ and $R^2$ each is hydrogen or an alkyl group such as methyl, ethyl, propyl, butyl or isobutyl; and $X^1$ is a halogen such as chlorine, bromine or fluorine),

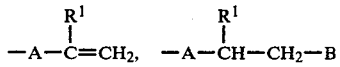

(wherein $R^1$ is defined above; A is an electron attracting group which can activate the terminal ethylenic bond, such as cyano, phenylsulfonyl, sulfamoyl, carbamoyl, sulfonyl or carbonyl group; and B is an atom or atoms capable of producing an ethylenic bonding at the terminal part by splitting an acid off the above-described functional group. The acid is formed by making B enter into combination with a hydrogen atom attached to the adjacent carbon. For example, B can be a halogen atom such as bromine or chlorine, an acetyl group or sulfonic acid ester residues). Other typical functional groups include —$SO_2X^1$ (wherein $X^1$ is defined above), —$COX^1$ (wherein $X^1$ is defined above),

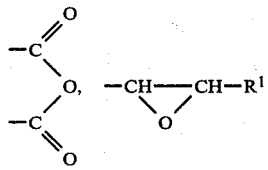

(wherein $R^1$ is defined above),

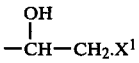

(wherein $X^1$ is defined above), —$CH_2X^1$ (wherein $X^1$ is defined above), —$COOR^3$ (wherein $R^3$ is an aryl group having an electron attracting group at the ortho or the para position, such as o-nitrophenyl, p-nitrophenyl or p-carboxylphenyl), and

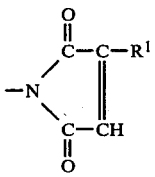

(wherein $R^1$ is defined above).

Specific examples of the above-described mono-functional compounds suitable for the preparation of gelatin derivatives for the present invention are described below. They include isocyanates or the precursors thereof, such as phenyl isocyanate, p-tolyl isocyanate, 4-bromophenyl isocyanate, 2-nitrophenyl isocyanate, 4-ethoxycarbonylphenyl isocyanate, 1-naphthyl isocyanate, phenyl isocyanate.bisulfite adduct, 4-biphenyl isocyanate.bisulfite adduct, etc.; thioisocyanates or the precursors thereof, such as phenyl thioisocyanate, p-tolyl thioisocyanate, phenyl thioisocyanate.bisulfite adduct, etc.; aziridines or the precursors thereof, such as N-pentanoyl-2-ethyl-1-aziridine, 1-phenylcarbamoylaziridine, 2-methyl-1-phenylcarbamoylaziridine, 1-dimethylaminosulfonylaziridine, 1-benzoylaziridine, 4-nitrobenzoyl-1-aziridine, 1-(2-chlorophenyl)carbamoyl-1-aziridine, 1-(3-methylphenyl)carbamoylaziridine, 1-(n-butylsulfonyl)aziridine, 1-(phenylsulfonyl)-2-methylaziridine, 2-(1-aziridinyl)-4,6-bis(ethylamino)-1,3,5-triazine, 1-phenyl-3-(2-chloroethyl)urea, etc.; active vinyl compounds or the precursors thereof, such as N-vinylsulfonyl-p-toluidine, vinylsulfonylbenzene, 1-methyl-4-vinylsulfonylbenzene, acrylonitrile, 1-(hydroxysulfonyloxy)-2-(4-methoxyphenylsulfonyl)ethane, 2-phenylcarbamoylethyl bromide, etc.; sulfonyl halides such as benzenesulfonyl chloride, 4-methoxybenzenesulfonyl chloride, 4-phenoxybenzenesulfonyl chloride, 4-chlorobenzenesulfonyl chloride, 4-bromobenzenesulfonyl chloride, 4-methylbenzenesulfonyl chloride, 3-nitrobenzenesulfonyl chloride, 3-carboxybenzenesulfonyl chloride, 2-naphthalenesulfonyl chloride, 4-aminobenzenesulfonyl fluoride, 3,4-diaminobenzenesulfonyl fluoride, 3-carboxybenzenesulfonyl fluoride, etc.; carboxylic acid halides such as 4-nitrobenzoyl chloride, 4-carboxybenzoyl bromide, etc.; acid anhydrides such as succinic anhydride, phthalic anhydride, hexahydrophthalic anhydride, isatoic anhydride, monomethylsuccinic anhydride, glutaric anhydride, benzoic anhydride, trimellitic anhydride, 3,6-dichlorophthalic anhydride, diglycollic anhydride, nitrophthalic anhydride, etc.; oxirane ring-containing compounds or the precursors thereof, such as 3-phenoxy-1,2-epoxypropane, 3-(3-methylphenoxy)-1,2-epoxypropane, 3-(2,4-dibromophenoxy)-1,2-epoxypropane, 3-(4-acetylaminophenoxy)-1,2-epoxypropane, 3-(2-biphenyloxy)-1,2-epoxypropane, 3-(2,4-dinitro-1-naphthoxy)-1,2-epoxypropane, 1-chloro-2-hydroxy-3-phenoxypropane, epichlorohydrin, 1-bromo-2-hydroxy-3-(2-chlorophenyl)propane, etc.; halomethyl compounds such as bromoacetic acid, chloroacetic acid, etc.; active esters such as o-nitrophenyl benzoate, p-nitrophenyl acetate, p-nitrophenyl-1-hydroxynaphthoate, etc.; maleic acid imides such as N-ethylmaleimide, N-phenylmaleimide, N-(p-carboxyphenyl)maleimide, N-(p-sulfophenyl)maleimide, etc.; and so on.

These compounds chemically modify gelatins using processes described below. The gelatin derivatives obtained as a result of the chemical modification greatly effect the adhesion of the second subbing layer to a hydrophilic organic colloid layer when used as a material for the subbing layer of a photographic light-sensitive material. Compounds which can increase the number of carboxyl groups in the side-chain of the gelatin such as succinic acid anhydride, phthalic acid anhydride, trimellitic acid anhydride are preferable.

The gelatin derivatives are prepared by a general process in which gelatins are allowed to react with the above-described mono-functional compounds. These compounds include a functional group which can undergo a reaction with some reactive group in a gelatin molecule. The reaction occurs in a solvent in which the gelatins are soluble. Examples of useful solvents include water, an organic solvent such as dimethyl sulfoxide, N,N-dimethylformamide, N,N-dimethylacetamide, tetramethyl urea, tetramethylene sulfone, acetic acid, and a mixed solvent of the organic solvent and water. The reaction proceeds in the presence of bases or acids which function as a pH controlling agent.

In the gelatin derivative, a functional group (which includes amino, imino, carboxyl and hydroxy groups) contained in the gelatin molecule is chemically modified. The substitution rate per any particular functional group in the chemical modification should be 50% or more. It should be pointed out with respect to the modifications of these functional groups that the modification of the amino group is the most effective. The substitution rate of the amino group is preferably 70% or more and more particularly 90% or more.

The gelatin derivative is coated on a support in an amount of 0.01 to 2.00 g (solid component), more particularly 0.05 to 0.50 g, per square meter of support.

In the second embodiment of the present invention, the polymer having the recurring unit of general formula (I) includes a homopolymer obtained by polymerizing the monomer shown by following general formula (III), a copolymer obtained by polymerizing the monomer shown by following general formula (III) with other monomers having at least one polymerizable unsaturated bond and a polymer obtained by introducing a sulfinic acid group into the side chain after finishing the aforesaid polymerization as well as the derivatives of those polymers:

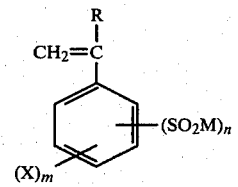

(III)

wherein R represents hydrogen, an alkyl group having 1 to 6 carbon atoms such as a methyl group, an ethyl group, etc., or a halogen such as chlorine, bromine, etc.; M represents hydrogen, an alkali metal such as sodium, potassium, etc., an alkaline earth metal such as calcium, magnesium, etc., or an organic base such as trimethylamine, triethylamine, etc.; X represents an alkyl group having 1 to 6 carbon atoms, an alkoxy group having 1 to 6 carbon atoms, an alkylamino group having 1 to 6 carbon atoms or a halogen such as chlorine, bromine, etc.; m is 0, 1 or 2; and n is 1 or 2.

Practical examples of the monomer shown by general formula (III) are as follows:

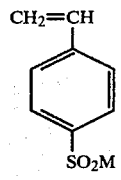

Monomer (A)

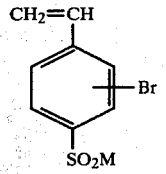

Monomer (B)

-continued

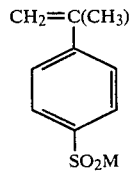

Monomer (C)

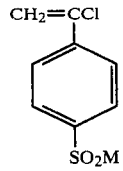

Monomer (D)

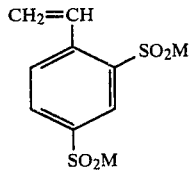

Monomer (E)

Among these monomers, a particularly preferred monomer is Monomer (A). Monomer (A) can be prepared according to the process described in *Chemistry Letters,* 419–420 (1976), which is incorporated herein by reference, although other process may be employed. Other monomers may be fundamentally prepared, if the corresponding sulfonic acid chloride is prepared, by the same process as described in the *Chemistry Letters* indicated above or by reducing the sulfonic acid chloride with a reducing agent such as sodium sulfite, etc., and, if desired, vinylating the product.

Also, the polymer having the recurring unit of general formula (I) may be prepared by the above-described process using a polymer reaction wherein a polymer such as polystyrene, etc., is used as the starting material.

In general, any monomer having at least one polymerizable unsaturated bond may be used to copolymerize the monomer of formula (III). Examples of such polymerizable unsaturated compound are allyl compounds such as allyl esters (e.g., allyl acetate, allyl caproate, allyl caprylate, allyl laurate, allyl palmitate, allyl stearate, allyl benzoate, allyl acetoacetate, allyl lacetate, etc.), allyloxy ethanol, allyl butyl ether, allyl glycidyl ether, allyl phenyl ether, etc.; vinyl ethers (e.g., methyl vinyl ether, butyl vinyl ether, hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl ether, hydroxyethyl vinyl ether, diethyleneglycol vinyl ether, dimethylaminoethyl vinyl ether, diethylaminoethyl vinyl ether, butyraminoethyl vinyl ether, benzyl vinyl ether, tetrahydrofurfuryl vinyl ether, vinyl phenyl ether, vinyl tolyl ether, vinyl chlorophenyl ether, vinyl-2,4-dichlorophenyl ether, vinyl naphthyl ether, vinyl anthranyl ether, etc.); vinyl esters such as vinyl acetate, vinyl propionate, vinyl butyrate, vinyl isobutyrate, vinyldimethyl propionate, vinylethyl butyrate, vinyl valerate, vinyl caprate, vinylchloroacetate, vinyl dichloroacetate, vinyl methoxyacetate, vinyl butoxyacetate, vinylphenyl acetate, vinyl acetoacetate, vinyl lactate, vinyl-$\beta$-phenyl butyrate, vinylcyclohexyl carboxylate, vinyl benzoate, vinyl salicylate, vinyl chlorobenzoate, vinyl tetrachlorobenzoate, vinyl naphthoate, etc.); vinyl heterocyclic compounds such as N-vinyloxazolidone, N-vinylimidazole, N-vinylpyrrolidone, N-vinylcarbazole, vinylthiophene, N-vinylethylacetamide, etc.; styrenes (e.g., styrene, methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, methoxystyrene, 4-methoxy-3-methylstyrene, dimethoxystyrene, chlorostyrene, dichlorostyrene, trichlorostyrene, tetrachlorostyrene, pentachlorostyrene, bromostyrene, dibromostyrene, indostyrene, fluorostyrene, trifluorostyrene, 2-bromo-4-trifluoromethylstyrene, 4-fluoro-3-trifluoromethylstyrene, vinylbenzoic acid methyl ester, etc.); crotonic acids such as crotonic acid, crotonic acid amide, crotonic acid ester (e.g., butyl crotonate, hexyl crotonate, glycerol monocrotonate, etc.); vinylketones (e.g., methyl vinyl ketone, phenyl vinyl ketone, methoxyethyl vinyl ketone, etc.); olefins (e.g., dicyclopentadiene, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,6,6-trimethyl-1-heptene, 1-dodecene, 1-octadecene, etc.); itaconic acids (e.g., itaconic acid, itaconic anhydride, methyl itaconate, ethyl itaconate, etc.); sorbic acid, cinnamic acid, methyl sorbate, glycidyl sorbate, citraconic acid, chloroacrylic acid, mesaconic acid, maleic acid, fumaric acid, ethacrylic acid, halogenated olefins (e.g., vinyl chloride, vinylidene chloride, isoprene, etc.), unsaturated nitriles (e.g., acrylonitrile, methacrylonitrile, etc.), acrylic acids (e.g., acrylic acid, methyl acrylate, etc.), methacrylic acids (e.g., methacrylic acid, methyl methacrylate, etc.), acrylamides, methacrylamides, etc.

Among these polymerizable unsaturated compounds, styrenes, vinyl heterocyclic compounds, vinyl ethers, vinyl esters, and olefins are particularly preferred.

It is necessary that the polymer having the recurring unit of general formula (I) contains at least 0.1 mol%, preferably 1 mol% or more, more preferably 10 mol% or more, of the recurring unit shown by general formula (I). When one or more kinds of these polymers are added in such a manner that the content becomes 0.01 to 99% by weight, preferably 0.1 to 50% by weight, more preferably 1 to 20% by weight, based on the solid content of the binder in the second subbing layer, the desired effect is obtained.

Examples of the polymer having the recurring unit shown by general formula (I) used in this invention are shown below, wherein the component ratios are all by mol ratio.

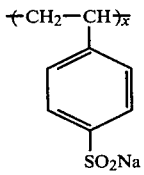

(1)

-continued
(2)
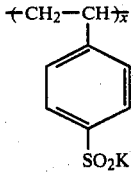
(3)
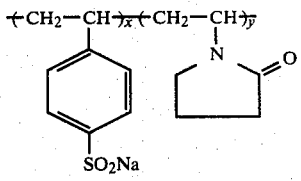
x/y = 80/20
(4)
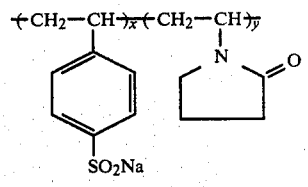
x/y = 50/50
(5)
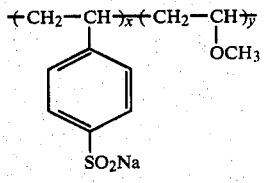
x/y = 50/50
(6)
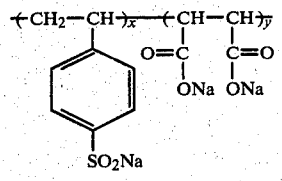
x/y = 50/50
(7)
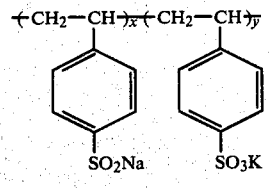
x/y = 75/25
(8)
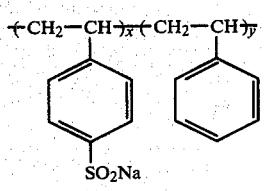
x/y = 70/30
(9)
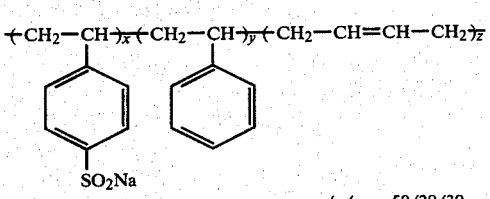
x/y/z = 50/20/30
-continued
(10)
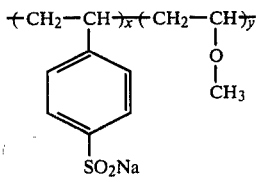
x/y = 60/40
(11)
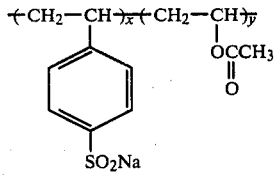
x/y = 80/20
(12)
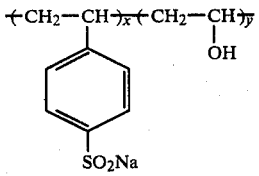
x/y = 80/20
(13)
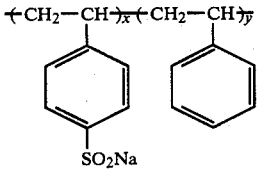
x/y = 5/95
(14)
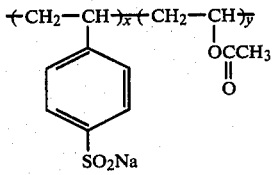
x/y = 10/90
Examples of the polymer having the recurring unit shown by general formula (II) used in this invention are shown below, wherein the component ratios are all by mol ratio.
(15)
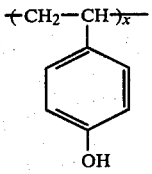
(16)
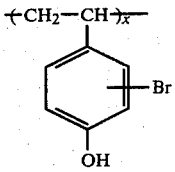

-continued (17)

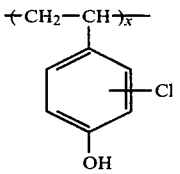

(18)

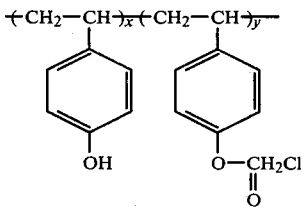

x/y = 60/40

(19)

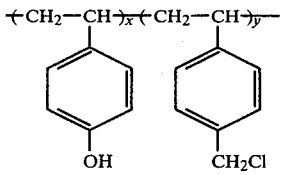

x/y = 75/25

(20)

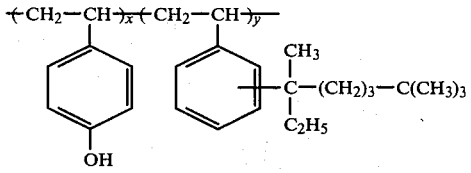

x/y = 75/25

(21)

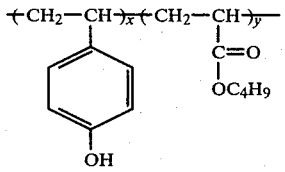

x/y = 45/55

(22)

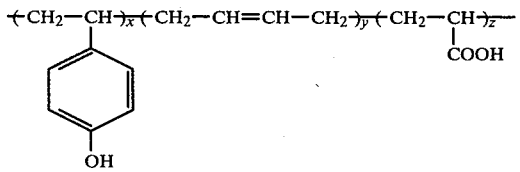

x/y/z = 55/40/5

(23)

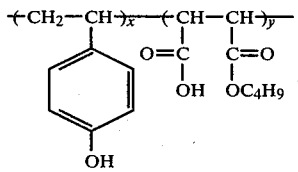

x/y = 50/50

-continued (24)

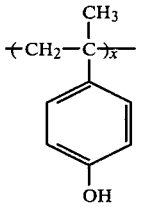

(25)

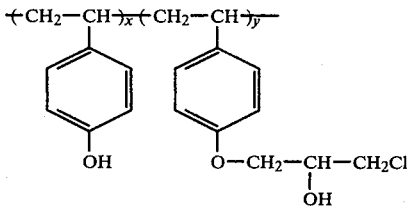

x/y = 20/80

Compounds (15) to (25) may be prepared by known manners, for example, by the polymerization processes described in *Journal of Polymer Science,* A-1, Vol. 7, pp. 2175 and 2405 (1969) using the monomers prepared by the processes described in *Journal of Organic Chemistry,* Vol. 23, p. 544 (1958), both incorporated herein by reference. Furthermore, some of the above-mentioned compounds can be obtained commercially. For example, the polymer illustrated as Compound (15) is available as a trade name "Resin M" and further the polymer illustrated as Compound (16) is available as a trade name "Resin MB" marketed by Maruzen Oil Co., Ltd., and the objects of this invention can be attained using such commercially available products.

It is necessary that the polymer having the recurring unit shown by general formula (II) used in this invention contains at least 0.1 mol%, preferably 1 mol% or more, more preferably 10 mol% or more, of the recurring unit of general formula (II). When one or more kinds of these polymers are added in such a manner that the content becomes 0.01 to 99% by weight, preferably 0.1 to 50% by weight, more particularly 1 to 20% by weight, based on the solid content of the binder in the second subbing layer, the desired effect is obtained.

Among the examples of the polymer above, compounds (1), (2) and (15) are more preferred, and compound (15) is most preferred.

The second subbing layer contains a binder in addition to the above-described polymer or polymers. Examples of the binder are hydrophilic colloids such as proteins (e.g., gelatin, colloidal albumin, casein, etc.), cellulose compounds (e.g., carboxymethyl cellulose, hydroxyethyl cellulose, etc.), sugar derivatives (e.g., agar agar, sodium alginate, starch derivatives, etc.) and synthetic hydrophilic colloids such as polyvinyl alcohol, poly-N-vinylpyrrolidone, polyacrylamide, the derivatives and partially hydrolyzed products of them, etc. If desired, two or more kinds of these colloids may be used. Among them, however, gelatin is more generally used. Gelatin includes so-called lime-processed gelatin, acid-processed gelatin, and enzyme-processed gelatin.

Various additives may be included in the subbing solution for the second subbing layer. Examples of such additives include: a matting agent, a surface active agent, an antistatic agent, an antihalation agent, a coloring dye, pigments, a coating aid, and an anti-fogging agent. The matting agent is an inorganic or an organic fine powder which has an average grain size of 1 to 5 microns. Examples of an inorganic matting agent include silica (silicon dioxide), magnesium oxide, titanium dioxide and calcium carbonate. Examples of an organic matting agent include polymethylmethacrylate, cellulose acetate propionate and polystyrene. Of these matting agents, preferable ones are silica and polymethylmethacrylate, especially polymethylmethacrylate.

The first subbing layer contains various macromolecular substances to increase adhesion to the plastic film support. Examples of macromolecular substances in the first subbing layer include copolymers which are prepared from vinyl chloride, vinylidene chloride, methacrylic acid, acrylic acid, methacrylic acid ester, acrylic acid ester, itaconic acid, maleic anhydride, vinyl acetate, butadiene or styrene. The copolymers which use as one of starting materials butadiene, styrene or vinylidene chloride are preferred. Synthesis examples and usage examples of these copolymers are described in detail in Japanese Patent Publications Nos. 13092/60 and 11779/61, Japanese Patent Applications (OPI) Nos. (the term "OPI" as used herein refers to a "published unexamined Japanese patent application") 43911/75, 131516/75, 135971/76, 49019/77, 58469/76, 117617/76, 121323/76, 123139/76, 139320/76, 65422/77, 96016/77, 108114/77, 109923/77 and 114121/76, U.S. Pat. Nos. 3,645,740, 4,087,574 and 4,039,333, and British Pat. Nos. 1,271,921, 1,532,517 and 1,520,076.

It is desirable to use a hardening agent in the first subbing layer. Examples of the hardening agent include: aldehyde series compounds such as formaldehyde, glyoxazole; ethyleneimino group-containing compounds such as mucochloric acid, tetramethylene-1,4-bis(ethyleneurea), hexamethylene-1,4-bis(ethyleneurea); methane sulfonates such as trimethylenebismethanesulfonate; active vinyl compounds such as bisacryloyl urea, m-xylenedivinyl sulfone; active halogen-containing compounds such as 2-methoxy-4,6-dichlorotriazine; epoxy group-containing compounds such bisphenol glycidyl ether; and isocyanates. Of these hardening agents, active halogen compounds, especially 2,4-dichloro-6-hydroxy-s-triazine sodium salt are particularly effective.

The subbing solution for the first subbing layer may include various additives. Examples of these additives include surface active agents, antistatic agents, antihalation agents, coloring dyes, pigments, coating aids, and anti-foggants. The subbing solution used for making the first subbing layer does not require any etching agent, such as resorcinol, chloral hydrate, or chlorophenol. However, an etching agent may be contained in the first subbing layer.

When a conventional subbing layer is placed on a plastic film support and a photographic layer containing a reduced amount of a hardener (to control photographic characteristics) is coated thereon, insufficient adhesion is obtained between the subbing layer and the photographic layer. However, when a gelatin derivative as described above or polymers having the repeating units of general formula (I) and/or the repeating unit of general formula (II) is incorporated in the subbing layer, strong adhesive power is unexpectedly obtained between the second subbing layer and a photographic layer. The improved adhesiveness is obtained even when the amount of the hardener in the photographic layer is reduced. Furthermore, if a polymer having the repeating unit of general formula (I) and/or the repeating unit of general formula (II) is incorporated in the subbing layer in addition to the gelatin derivatives, the adhesiveness between the second subbing layer and the photographic layer can be further strengthened.

The present subbing solutions can be coated using general well-known coating techniques. Examples of useable methods include: dip coating, air knife coating, curtain coating, roller coating, wire bar coating, gravure coating and extrusion coating utilizing a hopper as described in U.S. Pat. No. 2,681,294. Further, a plurality of layers can be coated at the same time using techniques as described in U.S. Pat. Nos. 2,761,791, 3,508,947, 2,941,898 and 3,526,528, and Yuji Harazaki, *Kōtingu Kōgaku* (*Coating Engineering*), p. 253, Asakura Shoten, Tokyo (1973). The subbing layer may be comprised of first and second subbing layers, and either of the two subbing layers may be comprised of a plurality of layers.

After the subbing layers have been coated on the support, they are dried in a subsequent drying process. Drying may be carried out at a temperature of 120° C. to 200° C. for 30 seconds to 10 minutes. The optimum drying conditions can be determined within the above-described ranges for each specific case.

The thickness of the second subbing layer according to the present invention is not limited to any particular range. However, preferred thickness of the second subbing layer is 0.01 to 1.0μ.

The term "plastic film support" is intended to include films made of plastics, such as cellulose esters (especially cellulose triacetate, cellulose diacetate and cellulose propionate), polyamides, polycarbonate, polyesters (especially polyethylene terephthalate, poly-1,4-cyclohexanedimethylene terephthalate, and polyethylene 1,2-diphenoxyethane-4,4'-dicarboxylate), polystyrene, polypropylene, polyethylene, and complex films made by coating or laminating the above-described plastics or plastic films, respectively, on papers or other supports.

Among these films, polyethylene terephthalate films are the best. In particular, polyethylene terephthalate films drawn in the biaxial directions and fixed thermally are desirable due to their excellent stability, sturdiness.

The thickness of the plastic film support is not limited to any particular range. However, films having a thickness of 15μ to 500μ, especially 40μ to 200μ, have desirable handling properties and wide applicability.

The support may be transparent, or contain dyes, or pigments, such as titanium dioxide. In addition, the support may contain silicon dioxide, alumina sol, chromium salts or zirconium salts.

A photographic light-sensitive material is made by coating photographic layers on a support which has provided thereon a subbing layer of the present invention. The coating is carried out using a commonly known coating technique.

The photographic layers include silver halide emulsion layers, an interlayer, a filter layer, a surface protecting layer and a backing layer.

The photographic layers each contains a hydrophilic colloid as a binder. Examples of the hydrophilic colloid include: gelatin, phthalated gelatin, maleated gelatin, carboxymethyl cellulose, hydroxyethyl cellulose, grafted gelatin, polyvinyl alcohol, polyhydroxyalkylacrylate, polyvinyl pyrrolidone, vinyl pyrrolidone-vinyl acetate copolymer. In addition to the hydrophilic colloids, the photographic layers may contain dispersions of synthetic polymers insoluble or slightly soluble in water. Useful synthetic polymers include: homopolymers prepared using as a monomer component such as alkyl(meth)acrylate, alkoxyalkyl(meth)acrylate, glycidyl(meth)acrylate, (meth)acryl amide, vinyl ester (e.g., vinyl acetate), acrylonitrile, olefin or styrene; copolymers prepared using a combination of a plurality of monomer components selected from the above-described monomers. Other useful copolymers include those prepared using a monomer components a combination of one or more of the monomer selected from the above-described ones with one or more of the monomers selected from a group comprising acrylic acid, methacrylic acid, $\alpha,\beta$-unsaturated dicarboxylic acid, hydroxyalkyl(meth)acrylate, sulfoalkyl(meth)acrylate and styrene sulfonic acid. These polymers are described in U.S. Pat. Nos. 2,376,005, 2,739,137, 2,853,457, 3,062,674, 3,411,911, 3,488,708, 3,525,620, 3,607,290, 3,635,715, and 3,645,740, and British Pat. Nos. 1,186,699 and 1,307,373.

The photographic layer may also contain silver halide grains, chemical sensitizers, an anti-foggant, a stabilizer, a hardener, an antistatic agent, a coating aid, a matting agent, a brightening agent, spectral sensitizing dyes, dyes and color couplers. Additives such as these are disclosed within *Research Disclosure,* Vol. 176, pp. 22–31 (December, 1978).

The present invention will now be illustrated in greater detail by reference to the following examples. However, the invention is not intended to be construed as being limited to these examples.

Syntheses of the gelatin derivatives may be carried out using a method as described in U.S. Pat. No. 3,923,517.

The adhesion test in each of the following examples was carried out in the following manner:

(1) Adhesion test in a dried condition

The emulsion sides of a raw stock film and a film which was developed and dried are cut reticulately at about 4 mm intervals with a blade of a razor. To the resulting emulsion surface, adhesive tape (made by Sumitomo 3M Co., Ltd., having the trade name of Scotch Permacell Tape) is applied. The tape is then peeled off quickly. When the emulsion layer is peeled off together with the adhesive tape in a proportion of not more than 5%, the film is ranked grade A. When the peeled-off proportion is from 5% to not more than 30%, the film is graded B, and when it is 30 to 100%, the film is graded C.

(2) Adhesion test in a wet condition

At each of stages, development, fixing and washing, two crossed scratches are inflicted on the emulsion side of a film with a stencil pen in the processing solution. The resulting scratched part is rubbed with a finger tip in the direction perpendicular to each of scratch lines. When the emulsion layer peels off in the scar part alone, the film is ranked grade A. When the maximum width of the peeled-off part is narrower than 5 mm, the film is graded B, and when it is not narrower than 5 mm, the film is graded C.

EXAMPLE 1

A first subbing layer having a composition described in Table 1 was provided on a biaxially oriented polyethylene terephthalate film. The coated film was dried at 180° C. for 1 minute. A second subbing layer having any of the compositions described in Table 1 was provided on the first subbing layer, dried at 120° C. for 1 minute and, thereafter, submitted to a heat treatment at 140° C. for 5 minutes. Several kinds of silver iodobromide emulsions (iodide content: 2.5 mol%) for radiographs which differed from one another in their hardener contents were prepared. The hardener contents are described in Table 1. On the subbing layer-coated film base, each of these silver halide emulsions was coated at the coverage of 3 g silver and 3.5 g gelatin per square meter. Thus, Samples (11) to (19) having compositions set forth in Table 1 were obtained.

TABLE 1

| Composition of Each Sample | | | | | |
|---|---|---|---|---|---|
| | Sample No. | | | | |
| | (11) | (12) | (13) | (14) | (15) |
| First Subbing Layer | Butadiene-styrene-acrylic acid copolymer latex (solid content: 50%, polymerization ratio by weight: 35/63/2): 10 cc<br>2,4-Dichloro-6-hydroxy-s-triazine.sodium salt (8% aqueous solution): 2 cc<br>Distilled water: 150 cc | | | | |
| Second Subbing Layer | Lime-processed gelatin 0.10 g/m$^2$ | Lime-processed gelatin 0.10 g/m$^2$ | Acid-processed gelatin 0.10 g/m$^2$ | Acid-processed gelatin 0.10 g/m$^2$ | Phthalated*1 gelatin 0.10 g/m$^2$ |
| Dry Thickness | The first subbing layer: about 0.5$\mu$<br>The second subbing layer: about 0.1$\mu$ | | | | |
| Hardener in Photographic Layer | 2,4-Dichloro-6-hydroxy-s-triazine.sodium salt | | | | |
| | 2 mmol/100 g gelatin | 1 mmol/100 g gelatin | 2 mmol/100 g gelatin | 1 mmol/100 g gelatin | 1 mmol/100 g gelatin |

| | Sample No. | | | |
|---|---|---|---|---|
| | (16) | (17) | (18) | (19) |
| First Subbing Layer | Butadiene-styrene-acrylic acid copolymer latex (solid content: 50%, polymerization ratio by weight: 35/63/2): 10 cc<br>2,4-Dichloro-6-hydroxy-s-triazine.sodium salt (8% aqueous solution): 2 cc<br>Distilled water: 150 cc | | | |
| Second Subbing Layer | Trimelliitylated*2 gelatin 0.10 g/m$^2$ | Succinylated*3 gelatin 0.10 g/m$^2$ | Phenylcarbamylated*4 gelatin 0.10 g/m$^2$ | Acetylated*5 gelatin 0.10 g/m$^2$ |
| Dry Thickness | The first subbing layer: about 0.5$\mu$<br>The second subbing layer: about 0.1$\mu$ | | | |
| Hardener in Photographic | 2,4-Dichloro-6-hydroxy-s-triazine.sodium salt: 1 mmol/100 g gelatin | | | |

TABLE 1-continued

| Composition of Each Sample | |
|---|---|
| Layer | |

*1 to *5: Substitution rate for amino group is 90% in each case.

The adhesiveness of each sample in the dried condition and in the wetted condition are shown in Table 2.

TABLE 2

| Result of Adhesion Test | | | | | | | | | |
|---|---|---|---|---|---|---|---|---|---|
| | Sample No. | | | | | | | | |
| | (11) | (12) | (13) | (14) | (15) | (16) | (17) | (18) | (19) |
| Dry | A | A | A | A | A | A | A | A | A |
| Wet | B | C | B | C | A | A | A | B | B |

The results in Table 2 show the adhesiveness decreases as the hardener content in the photographic layer is decreased. Table 2 shows that Samples (15) to (19), in which gelatin derivatives were used, exhibited excellent adhesiveness even when the hardener contents in their photographic layers were reduced. Of these samples, phthalated gelatin-, trimellitylated gelatin- and succinylated gelatin-utilizing samples were found to exhibit particularly excellent adhesiveness.

EXAMPLE 2

A polyethylene terephthalate film is coated with the same first subbing layer as in Example 1. The first subbing layer is coated with a second subbing layer of phthalated gelatins, which differ from one another in the substitution rate for the amino group as shown in Table 3. The coated film was dried at 120° C. for 1 minute and then subjected to a heat treatment at 140° C. for 5 minutes. Next, a silver halide emulsion for a radiograph was coated in the same manner as in Example 1, and Samples (21) to (26) were obtained.

TABLE 3

| | Composition of Each Sample | | | | | |
|---|---|---|---|---|---|---|
| | Sample No. | | | | | |
| | (21) | (22) | (23) | (24) | (25) | (26) |
| Second Subbing Layer | | | | | | |
| Constituent substance | Phthalated gelatin: 0.10 g/m$^2$ | | | | | |
| Substitution Rate | 0% | 30% | 50% | 70% | 85% | 95% |
| Dry Thickness | First subbing layer: about 0.5μ<br>Second subbing layer: about 0.1μ | | | | | |
| Hardener in Photographic | 2,4-Dichloro-6-hydroxy-s-triazine.sodium salt: 1 mmol/100 g gelatin | | | | | |

TABLE 3-continued

| | Composition of Each Sample | | | | | |
|---|---|---|---|---|---|---|
| | Sample No. | | | | | |
| | (21) | (22) | (23) | (24) | (25) | (26) |
| Layer | | | | | | |

The samples exhibited adhesion powers as evaluated in Table 4 in the dried and the wetted conditions, respectively.

TABLE 4

| Result of Adhesion Test | | | | | | |
|---|---|---|---|---|---|---|
| | Sample No. | | | | | |
| | (21) | (22) | (23) | (24) | (25) | (26) |
| Dry | A | A | A | A | A | A |
| Wet | C | C | C | B | A | A |

As can be seen from Table 4, the higher the substitution rate of the gelatin derivative contained in the second subbing layer, the greater the adhesiveness created.

EXAMPLE 3

A polyethylene terephthalate film is coated with the same first subbing layer as Example 1. A second subbing layer having a composition as shown in Table 5 was coated on the first subbing layer, dried at 120° C. for 1 minute and, thereafter, subjected to a heat treatment at 140° C. for 5 minutes. A silver halide emulsion for a radiograph is coated on the second subbing layer in the same manner as in Example 1. Thus, Samples (31) to (37) were obtained.

TABLE 5

| | Composition of Each Sample | | | | | | |
|---|---|---|---|---|---|---|---|
| | Sample No. | | | | | | |
| | (31) | (32) | (33) | (34) | (35) | (36) | (37) |
| Second Subbing Layer | Phthalated gelatin (substitution rate: 70%): 0.10 g/m$^2$ | | | | | | |
| | — | Polymer of Compound Example (2) | | Polymer of Compound Example (15) | | $\leftarrow CH_2-\underset{\underset{COONa}{\vert}}{CH}\rightarrow_n$ | |
| | — | 0.05 g/ 1 g gelatin | 0.10 g/ 1 g gelatin | 0.05 g/ 1 g gelatin | 0.10 g/ 1 g gelatin | 0.05 g/ 1 g gelatin | 0.10 g/ 1 g gelatin |
| Matting Agent | Polymethylmethacrylate (average grain size of 2 μm): 5 mg/m$^2$ | | | | | | |
| Dry Thickness | The first subbing layer: about 0.5μ<br>The second subbing layer: about 0.1μ | | | | | | |
| Hardener in Photographic Layer | 2,4-Dichloro-6-hydroxy-s-triazine.sodium salt: 1 mmol/100 g gelatin | | | | | | |

The adhesion powers exhibited by the samples in both dried and wetted conditions are shown in Table 6.

TABLE 6

| Result of Adhesion Test | | | | | | | |
|---|---|---|---|---|---|---|---|
| | Sample No. | | | | | | |
| | (31) | (32) | (33) | (34) | (35) | (36) | (37) |
| Dry | A | A | A | A | A | A | A |
| Wet | B | A | A | A | A | B | B |

Table 6 shows that the addition of the polymer represented by Compound Example (2) or (15) to the gelatin derivative contributed to increasing adhesiveness.

EXAMPLE 4

A polyethylene terephthalate film is coated with the same first subbing layer as Example 1. A second subbing layer having a composition as set forth in Table 7 was coated on the first subbing layer, dried at 120° C. for 1 minute and, thereafter, subjected to a het treatment at 140° C. for 5 minutes. A silver halide emulsion for a radiograph was coated on the second subbing layer in the same manner as in Example 1. Thus, Samples (41) to (46) were prepared.

TABLE 7

| | Composition of Each Sample | | | | | |
|---|---|---|---|---|---|---|
| | Sample No. | | | | | |
| | (41) | (42) | (43) | (44) | (45) | (46) |
| Second Subbing Layer | Phthalated gelatin*/Lime processed gelatin (weight ratio) | | | | | |
| | 1/0 | 0.8/0.2 | 0.6/0.4 | 0.4/0.6 | 0.2/0.8 | 0/1 |
| | 0.10 g/m$^2$ | | | | | |
| Dry Thickness | The first subbing layer: about 0.5μ<br>The second subbing layer: about 0.1μ | | | | | |
| Hardener in Photographic Layer | 2,4-Dichloro-6-hydroxy-s-triazine.sodium salt: 1 mmol/100 g gelatin | | | | | |

*Having substitution rate of 90%

The adhesion powers exhibited by the samples in both dried and wetted conditions are set forth in Table 8.

TABLE 8

| | Result of Adhesion Test | | | | | |
|---|---|---|---|---|---|---|
| | Sample No. | | | | | |
| | (41) | (42) | (43) | (44) | (45) | (46) |
| Dry | A | A | A | A | A | A |
| Wet | A | A | B | C | C | C |

Table 8 shows that the higher the content of phthalated gelatin in the second subbing layer, the greater the adhesiveness.

EXAMPLE 5

A first subbing layer having a composition described in Table 9 was provided on a polyethylene terephthalate film. The film had been oriented and crystallized by receiving a drawing treatment in a biaxial direction. The coated film was dried at 120° C. for 3 minutes. A second subbing layer having any of the compositions described in Table 9 was provided on the first subbing layer, dried at 120° C. for 1 minute and then subjected to a heat treatment at 140° C. for 5 minutes. Silver halide emulsions for radiographs were prepared to include different amounts of hardener as shown in Table 9. These emulsions were coated on the second subbing layer in the same manner as in Example 1. Thus, Samples (51) to (59) were obtained.

TABLE 9

| | Composition of Each Sample | | | | | | | | |
|---|---|---|---|---|---|---|---|---|---|
| | Sample No. | | | | | | | | |
| | (51) | (52) | (53) | (54) | (55) | (56) | (57) | (58) | (59) |
| First Subbing Layer | The subbing solution 4 described in Example 3 of U.S. Pat. No. 4,087,574. | | | | | | | | |
| Second Subbing Layer | Lime-processed gelatin | Lime-processed gelatin | Acid-processed gelatin | Acid-processed gelatin | *1 Phthalated gelatin | *2 Trimellitylated gelatin | *3 Succinylated gelatin | *4 Phenyl-carbamylated gelatin | *5 Acetylated gelatin |
| | 0.10 g/m$^2$ | 0.10 g/m$^2$ | 0.10 g/m$^2$ | 0.10 g/m$^2$ | 0.10 g/m$^2$ | 0.10 g/m$^2$ | 0.10 g/m$^2$ | 0.10 g/m$^2$ | 0.10 g/m$^2$ |
| Dry Thickness | The first subbing layer: about 0.5μ<br>The second subbing layer: about 0.1μ | | | | | | | | |
| Hardener in Photographic Layer | 2,4-Dichloro-6-hydroxy-s-triazine.sodium salt | | | | 2,4-Dichloro-6-hydroxy-s-triazine.sodium salt: 1 mmol/100 g gelatin | | | | |
| | 2 mmol/100 g gelatin | 1 mmol/100 g gelatin | 2 mmol/100 g gelatin | 1 mmol/100 g gelatin | | | | | |

*1 to *5: Substitution rate for amino group is 90% in each gelatin derivative.

The adhesive powers exhibited by the samples in both dried and wetted conditions are shown in Table 10.

TABLE 10

| | Result of Adhesion Test | | | | | | | | |
|---|---|---|---|---|---|---|---|---|---|
| | Sample No. | | | | | | | | |
| | (51) | (52) | (53) | (54) | (55) | (56) | (57) | (58) | (59) |
| Dry | A | A | A | A | A | A | A | A | A |
| Wet | B | C | B | C | A | A | A | B | B |

Table 10 shows that Samples (55) to (59) exhibited excellent adhesiveness even when the hardener contents in their photographic layers were reduced. Of these samples, phthalated gelatin-, trimellitylated gelatin- and succinylated gelatin-utilizing samples were found to exhibit particularly excellent adhesiveness.

COMPARISON EXAMPLE

A first subbing layer having the composition shown in Table 11 was formed on a biaxially oriented polyethylene terephthalate film and dried for 1 minute at 180° C. Then, a second subbing layer having the composition shown in Table 11 was formed on the first subbing layer, dried for 1 minute at 120° C., and heat-treated for 5 minutes at 140° C. On the subbing layer-coated film base was coated a radiographic silver halide emulsion (AgBrI, I=2.5 mol%) with 3 g of silver and 3.5 g of gelatin per square meter. By changing the coverage of the hardening agent shown in Table 11, Samples (101) to (105) were obtained.

TABLE 11

| | Composition of Each Sample | | | | |
|---|---|---|---|---|---|
| | Sample No. | | | | |
| | (101) | (102) | (103) | (104) | (105) |
| First Subbing Layer | Butadiene-styrene-acrylic acid copolymer latex (solid content: 50%, polymerization ratio by weight: 35/63/2): 10 cc<br>2,4-Dichloro-6-hydroxy-s-triazine.sodium salt (8% aqueous solution): 2 cc<br>Distilled water: 150 cc | | | | |
| Second Subbing Layer | Lime-processed gelatin: 0.10 g/m$^2$ | | | | |
| Dry Thickness | First subbing layer: about 0.5μ<br>Second subbing layer: about 0.1μ | | | | |
| Hardener in Photographic Layer | 2,4-Dichloro-6-hydroxy-s-triazine.sodium salt | | | | |
| | 0.5 mmol/ 100 g gelatin | 1 mmol/ 100 g gelatin | 2 mmol/ 100 g gelatin | 3 mmol/ 100 g gelatin | 4 mmol/ 100 g gelatin |

The adhesive strengths of the samples thus-obtained at drying and wetting are as shown in Table 12.

TABLE 12

| | Result of Adhesion Test | | | | |
|---|---|---|---|---|---|
| | Sample No. | | | | |
| | (101) | (102) | (103) | (104) | (105) |
| Dry | A | A | A | A | A |
| Wet | C | C | C | B | A |

From the results shown in Table 12, it is understood that the adhesive strength is insufficient when the amount of the hardener in the photographic layer is reduced.

EXAMPLE 6

A first subbing layer having the composition of the Comparison Example was formed on a polyethylene terephthalate film, and a second subbing layer having the composition as shown in Table 13 was formed thereon. The layers were dried for 1 minute at 120° C. and then heat-treated for 5 minutes at 140° C. Then, a radiographic silver halide emulsion was coated thereon as in the Comparison Example while changing the amount of the hardener as shown in Table 13 to provide Samples (61) to (67).

TABLE 13

| | Composition of Each Sample | | | | | | |
|---|---|---|---|---|---|---|---|
| | Sample No. | | | | | | |
| | (61)* | (62) | (63) | (64) | (65) | (66) | (67) |
| Second Subbing Layer | Lime-processed gelatin: 0.10 g/m$^2$ | | | | | | |
| | — | Polymer of Compound Example (1) 0.05 g/ g-gelatin | Polymer of Compound Example (1) 0.10 g/ g-gelatin | Polymer of Compound Example (1) 0.15 g/ g-gelatin | Polymer of Compound Example (15) 0.05 g/ g-gelatin | Polymer of Compound Example (15) 0.10 g/ g-gelatin | Polymer of Compound Example (15) 0.15 g/ g-gelatin |
| Dry Thickness | First subbing layer: about 0.5μ<br>Second subbing layer: about 0.1μ | | | | | | |
| Hardener in Photographic Layer | 2,4-Dichloro-6-hydroxy-s-triazine.sodium salt | | | | | | |
| | 2 mmol/ 100 g-gelatin | 1 mmol/ 100 g-gelatin | 1 mmol/ 100 g-gelatin | 1 mmol/ 100 g-gelatin | 1 mmol/ 100 g-gelatin | 1 mmol/ 100 g-gelatin | mmol/ 100 g-gelatin |

*Comparison Sample

The adhesive strengths of the samples thus-obtained at drying and wetting are as shown in Table 14.

TABLE 14

| | Result of Adhesion Test | | | | | | |
|---|---|---|---|---|---|---|---|
| | Sample No. | | | | | | |
| | (61)* | (62) | (63) | (64) | (65) | (66) | (67) |
| Dry | A | A | A | A | A | A | A |
| Wet | C | A | A | A | A | A | A |

*Comparison Sample

From the results shown in Table 14, it is understood that Samples (62) to (67) containing Compound Example (1) or (15) show good adhesive strength as compared with Comparison Example (61). The improved results are observed even when the amount of the hardener in the photographic layer is reduced to half the amount in the comparison sample.

EXAMPLE 7

A first subbing layer having the composition of the Comparison Example was formed on a polyethylene terephthalate film, and a second subbing layer as shown in Table 15 was formed thereon. The layers were dried for 1 minute at 120° C. and then heat-treated for 5 minutes at 140° C. Thereafter, a radiographic silver halide emulsion was coated thereon while changing the amount of the hardener as shown in Table 15 to provide Samples (71) to (78).

TABLE 15

| | Composition of Each Sample | | | | | | | |
|---|---|---|---|---|---|---|---|---|
| | Sample No. | | | | | | | |
| | (71)* | (72) | (73) | (74) | (75) | (76) | (77) | (78) |
| Second Subbing Layer | Lime-processed gelatin: 0.10 g/m$^2$ | | | | | | | |

TABLE 15-continued

| | Composition of Each Sample | | | | | | | |
|---|---|---|---|---|---|---|---|---|
| | Sample No. | | | | | | | |
| | (71)* | (72) | (73) | (74) | (75) | (76) | (77) | (78) |
| | — | Polymer of Compound Example (3) | Polymer of Compound Example (7) | Polymer of Compound Example (12) | Polymer of Compound Example (16) | Polymer of Compound Example (19) | Polymer of Compound Example (24) | $-(CH_2-CH)_n-$ (C=O, ONa) |
| | — | 0.10 g/g-gelatin | 0.10 g/g-gelatin | 0.10 g/g-gelatin | 0.10 g/g-gelatin | 0.10 g/g-gelatin | 0.10 g/g-gelatin | 0.10 g/g-gelatin |
| Dry Thickness | First subbing layer: about 0.5μ<br>Second subbing layer: about 0.1μ | | | | | | | |
| Hardener in Photographic Layer | 2,4-Dichloro-6-hydroxy-s-triazine.sodium salt | | | | | | | |
| | 2 mmol/100 g-gelatin | 1 mmol/100 g-gelatin | 1 mmol/100 g-gelatin | 1 mmol/100 g-gelatin | 1 mmol/100 g-gelatin | 1 mmol/100 g-gelatin | 1 mmol/100 g-gelatin | 1 mmol/100 g-gelatin |

*Comparison Sample

The adhesive strengths of the samples thus-obtained at drying and wetting are as shown in Table 16.

TABLE 16

| | Result of Adhesion Test | | | | | | | |
|---|---|---|---|---|---|---|---|---|
| | Sample No. | | | | | | | |
| | (71)* | (72) | (73) | (74) | (75) | (76) | (77) | (78) |
| Dry | A | A | A | A | A | A | A | A |
| Wet | C | A | A | A | A | A | A | C |

*Comparison Sample

From the results shown in Table 16, it is understood that Samples (72) to (77) containing polymers of Compound Examples (3), (7), (12), (16), (19) and (24) of this invention in the second subbing layers have good adhesion even if the amount of the hardener in the photographic layer is reduced to half of the Comparison Sample (71).

EXAMPLE 8

A first subbing layer having the composition shown in Table 17 was formed on a biaxially oriented polyethylene terephthalate film. The layer was dried for 3 minutes at 120° C. Then, on the first subbing layer was formed a second subbing layer having the composition shown in Table 17. The layer was dried for 1 minute at 120° C. and thereafter heat-treated for 5 minutes at 140° C. Then, a radiographic silver halide emulsion was coated thereon while changing the amount of the hardener as shown in Table 17 to provide Samples (81) to (87).

TABLE 17

| | Composition of Each Sample | | | | | | |
|---|---|---|---|---|---|---|---|
| | Sample No. | | | | | | |
| | (81)* | (82) | (83) | (84) | (85) | (86) | (87) |
| First Subbing Layer | The subbing solution 4 described in Example 3 of U.S. Pat. No. 4,087,574. | | | | | | |
| Second Subbing Layer | Lime processed gelatin: 0.10 g/m$^2$ | | | | | | |
| | — | Polymer of Compound Example (2) | Polymer of Compound Example (2) | Polymer of Compound Example (15) | Polymer of Compound Example (15) | $-(CH_2-CH)_n-$ (COONa) | |
| | — | 0.05 g/g-gelatin | 0.15 g/g-gelatin | 0.05 g/g-gelatin | 0.15 g/g-gelatin | 0.05 g/g-gelatin | 0.15 g/g-gelatin |
| Dry Thickness | First subbing layer: about 0.5μ<br>Second subbing layer: about 0.1μ | | | | | | |
| Hardener in Photographic Layer | 2,4-Dichloro-6-hydroxy-s-triazine.sodium salt | | | | | | |
| | 2 mmol/100 g-gelatin | 1 mmol/100 g-gelatin | 1 mmol/100 g-gelatin | 1 mmol/100 g-gelatin | 1 mmol/100 g-gelatin | 1 mmol/100 g-gelatin | 1 mmol/100 g-gelatin |

*Comparison Sample

The adhesive strength of the sample thus-obtained at drying and wetting is as shown in Table 18.

TABLE 18

| | Result of Adhesion Test | | | | | | |
|---|---|---|---|---|---|---|---|
| | Sample No. | | | | | | |
| | (81)* | (82) | (83) | (84) | (85) | (86) | (87) |
| Dry | A | A | A | A | A | A | A |
| Wet | C | A | A | A | A | C | C |

*Comparison Sample

From the results shown in Table 18, it is understood that Samples (82) to (85) containing Compound Example (2) or (15) have good adhesion as compared with that of Comparison Example (81). The improved adhesion is apparent even when the amount of the hardening agent is reduced to half that of Comparison Example (81).

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising:

a support;

a subbing layer;

a light-sensitive emulsion layer containing an hydrophilic organic colloid and a hardener; and a gelatin derivative-containing layer positioned between said subbing layer and said light-sensitive emulsion layer, wherein said gelatin derivative is prepared by chemically modifying gelatin with an agent to increase the number of carboxylic groups in a side chain of the gelatin, said agent being an acid anhydride selected from the group consisting of succinic anhydride, phthalic anhydride or trimellitic anhydride.

2. The photographic light-sensitive material claimed in claim 1, wherein said gelatin derivative has a substitution rate of 50% or more for any functional group contained in a parent gelatin used to produce said gelatin derivative.

3. The photographic light-sensitive material claimed in claim 1, wherein said gelatin derivative comprises 60 wt% or more of said gelatin derivative-containing layer.

4. The photographic light-sensitive material claimed in claim 1, wherein said gelatin derivative-containing layer includes a polymer having at least 0.1 mol% of a recurring unit represented by the general formula (I):

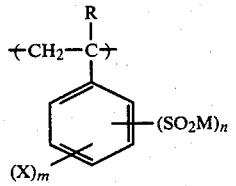

(I)

wherein R is hydrogen, an alkyl group containing 1 to 6 carbon atoms or a halogen; M is hydrogen, an alkali metal, an alkaline earth metal or a n organic base; X is an alkyl group containing 1 to 6 carbon atoms, an alkylamino group containing 1 to 6 carbon atoms, or a halogen; m is 0, 1 or 2; and n is 1 or 2.

5. The photographic light-sensitive material claimed in claim 1, wherein said gelatin derivative-containing layer has a thickness of 0.01 to 1.0$\mu$.

6. The photographic light-sensitive material claimed in claim 4, wherein said organic base is selected from the group consisting of trimethylamine or triethylamine.

7. A photographic light-sensitive material comprising:

a support;

a subbing layer;

a light-sensitive photographic layer containing an hydrophilic organic colloid and a hardener; and a layer containing an hydrophilic organic colloid and a polymer having a recurring unit, said layer being positioned between said subbing layer and said photographic layer, wherein said polymer having a recurring unit contains at least 0.1 mol% of said recurring unit which is represented by the general formula (I), wherein said general formula (I) is:

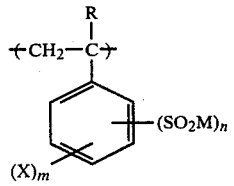

(I)

wherein R is a hydrogen, an alkyl group having 1 to 6 carbon atoms or a halogen; M is a hydrogen, an alkali metal, an alkaline earth metal or an organic base; X is an alkyl group having 1 to 6 carbon atoms, an alkoxy group having 1 to 6 carbon atoms, an alkylamino group having 1 to 6 carbon atoms or a halogen; m is 0, 1 or 2; and n is 1 or 2.

8. The photographic light-sensitive material as claimed in claim 7, wherein the photographic layer is a silver halide emulsion layer.

9. The photographic light-sensitive material as claimed in claim 7, wherein the subbing layer is comprised of a first subbing layer disposed adjacent to the support and a second subbing layer, said second subbing layer containing said polymer.

10. The photographic light-sensitive material as claimed in claim 7, wherein R is hydrogen, M is sodium or potassium, m is 0, n is 1, R′ is hydrogen, m′ is 0, and n′ is 1.

11. The photographic light-sensitive material as claimed in claim 4 wherein said polymer has at least 1 mol% of said unit represented by general formula (I).

12. The photographic light-sensitive material as claimed in claim 7 wherein said polymer has at least 1 mol% of said unit represented by general formula (I).

13. The photographic light-sensitive material claimed in claim 7, wherein said polymer is a homopolymer having the recurring unit represented by formula (I) wherein R is hydrogen, M is sodium or potassium, m is 0, n is 1, R′ is hydrogen, m′ is 0 and n′ is 1.

14. The photographic light-sensitive material claimed in claim 7, wherein said polymer is a copolymer of a monomer having the recurring unit represented by the formula (I) wherein R is hydrogen, M is sodium or potassium, m is 0, n is 1, R′ is hydrogen, m′ is 0 and n′ is 1, wherein said copolymer comprises a comonomer selected from the group consisting of styrenes, vinyl heterocyclic compounds, vinyl ethers, vinyl esters and olefins.

15. The photographic light-sensitive material claimed in claim 7, wherein said polymer is selected from the group consisting of polymers (1) to (25) below:

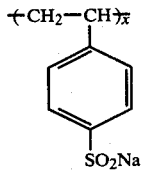

(1)

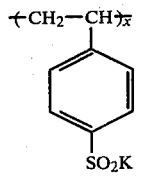

(2)

-continued (3)

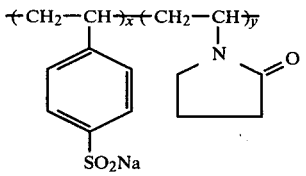

x/y = 80/20

(4)

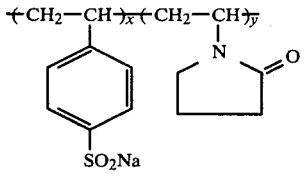

x/y = 50/50

(5)

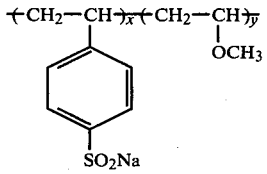

x/y = 50/50

(6)

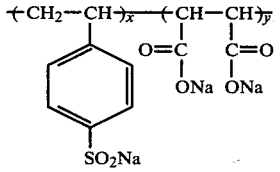

x/y = 50/50

(7)

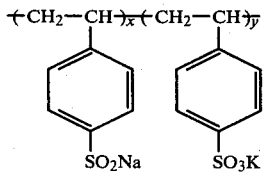

x/y = 75/25

(8)

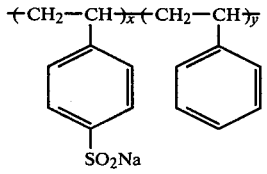

x/y = 70/30

-continued (9)

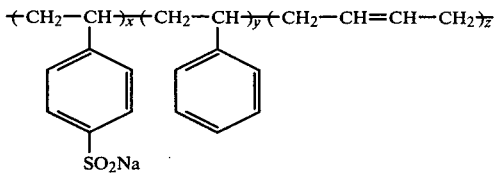

x/y/z = 50/20/30

(10)

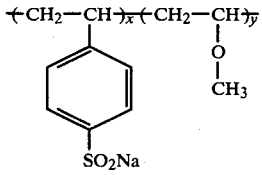

x/y = 60/40

(11)

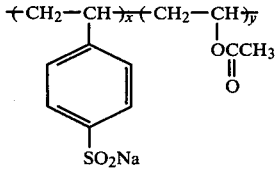

x/y = 80/20

(12)

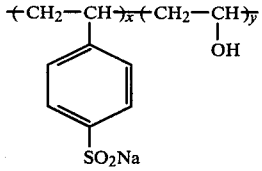

x/y = 80/20

(13)

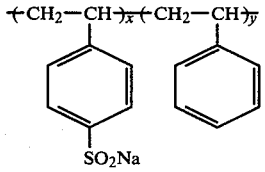

x/y = 5/95 and (14)

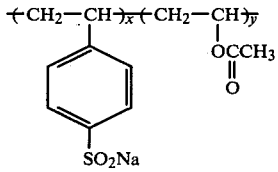

x/y = 10/90

16. The photographic light-sensitive material claimed in claim 15, wherein said polymer is selected from the group consisting of polymers (1), (2), (3), (7) and (12).

17. The photographic light-sensitive material claimed in claim 15, wherein said polymer is selected from the group consisting of polymers (1) and (2).

* * * * *